US007225717B2

(12) United States Patent
Williams

(10) Patent No.: US 7,225,717 B2
(45) Date of Patent: Jun. 5, 2007

(54) VEHICLE ARMOR SYSTEM

(75) Inventor: Charles A. Williams, Bradenton, FL (US)

(73) Assignee: Square One Armoring Services Company, Miami, FL (US)

( * ) Notice: Subject to any disclaimer, the term of this patent is extended or adjusted under 35 U.S.C. 154(b) by 0 days.

(21) Appl. No.: 11/152,465

(22) Filed: Jun. 14, 2005

(65) Prior Publication Data

US 2007/0028759 A1 Feb. 8, 2007

Related U.S. Application Data

(60) Provisional application No. 60/579,642, filed on Jun. 15, 2004.

(51) Int. Cl.
*F41H 5/04* (2006.01)

(52) U.S. Cl. ..... 89/36.08; 89/36.01; 89/36.02

(58) Field of Classification Search ..... 89/36.01, 89/36.07, 36.08, 36.09; 296/187.07, 193.03, 296/193.04

See application file for complete search history.

(56) References Cited

U.S. PATENT DOCUMENTS

| | | | | | |
|---|---|---|---|---|---|
| 2,038,439 | A | | 4/1936 | Moss | 29/148 |
| 2,054,665 | A | * | 9/1936 | Tracy | 52/461 |
| 2,185,209 | A | | 1/1940 | Love | 296/24 |
| 2,371,823 | A | | 3/1945 | Jackson | 219/10 |
| 2,382,862 | A | | 8/1945 | Davis, Jr. | 89/36 |
| 3,263,385 | A | * | 8/1966 | Pauls | 52/461 |
| 3,390,504 | A | * | 7/1968 | Van Elten | 52/588.1 |
| 3,699,842 | A | | 10/1972 | Grewing et al. | 89/36 H |
| 3,770,393 | A | | 11/1973 | Hoy et al. | 29/191 |
| 4,028,856 | A | * | 6/1977 | Dalbec | 52/281 |
| 4,036,104 | A | | 7/1977 | Pagano et al. | 89/36 H |
| 4,167,889 | A | | 9/1979 | Bohne et al. | 89/36 A |
| 4,316,404 | A | * | 2/1982 | Medlin | 89/36.08 |
| 4,325,283 | A | | 4/1982 | Bemiss | 89/36 F |
| 4,326,445 | A | | 4/1982 | Bemiss | 89/36 F |
| 4,351,558 | A | | 9/1982 | Mueller | 296/187 |
| 4,398,446 | A | | 8/1983 | Pagano et al. | 89/36 H |
| 4,412,122 | A | | 10/1983 | Böhm et al. | 219/137 R |
| 4,524,674 | A | | 6/1985 | Gilvydis | 89/36 H |
| 4,534,205 | A | | 8/1985 | Van Caneghem | 73/12 |
| 4,566,237 | A | * | 1/1986 | Turner | 52/269 |
| H129 | H | | 9/1986 | Hansen | 89/36.04 |
| 4,757,742 | A | | 7/1988 | Mazelsky | 89/36.02 |
| 4,806,435 | A | | 2/1989 | Athey | 428/594 |
| 4,841,838 | A | | 6/1989 | Scully et al. | 89/36.08 |
| 4,957,034 | A | | 9/1990 | Tasdemiroglu | 89/36.02 |
| 5,149,910 | A | | 9/1992 | McKee | 89/36.02 |
| 5,206,451 | A | | 4/1993 | Böcker | 89/36.02 |
| 5,318,216 | A | | 6/1994 | Berniolles | 228/171 |
| 5,349,893 | A | | 9/1994 | Dunn | 89/36.05 |

(Continued)

*Primary Examiner*—Troy Chambers
*Assistant Examiner*—Stewart T Knox
(74) *Attorney, Agent, or Firm*—Fitzpatrick, Cella, Harper & Scinto

(57) ABSTRACT

An armor system is provided for installation in a vehicle having a body structure. The armor system includes frame members joined to form a framework having openings. The framework is joined to the inside of the body structure of the vehicle. Brackets are joined to the frame members. A number of armor plates are provided, which are configured to cover the openings of the framework. Each plate is joined to at least one of the brackets, so that gaps between the armor plates are overlapped by the frame members.

19 Claims, 6 Drawing Sheets

U.S. PATENT DOCUMENTS

| | | | | | |
|---|---|---|---|---|---|
| H1434 | H | * | 5/1995 | Cytron | 89/36.02 |
| 5,600,084 | A | | 2/1997 | Gonzalez | 89/36.02 |
| 5,600,085 | A | | 2/1997 | Schalke et al. | 89/36.08 |
| 5,686,689 | A | | 11/1997 | Snedeker et al. | 89/36.02 |
| 5,792,974 | A | * | 8/1998 | Daqis et al. | 89/36.02 |
| 5,822,936 | A | | 10/1998 | Bateman | 52/281 |
| 6,009,789 | A | | 1/2000 | Lyons | 89/36.02 |
| 6,082,240 | A | * | 7/2000 | Middione et al. | 89/36.08 |
| 6,187,451 | B1 | | 2/2001 | Boos | 428/598 |
| 6,216,579 | B1 | | 4/2001 | Boos et al. | 89/36.02 |
| 6,327,954 | B1 | * | 12/2001 | Medlin | 89/36.08 |
| 6,332,390 | B1 | * | 12/2001 | Lyons | 89/36.02 |
| 6,510,777 | B2 | | 1/2003 | Neal | 89/36.05 |
| 6,523,450 | B1 | | 2/2003 | Schreiber | 89/36.11 |
| 6,718,861 | B1 | | 4/2004 | Anderson, Jr. et al. | 89/36.02 |
| 6,920,817 | B2 | * | 7/2005 | Ravid et al. | 89/36.11 |
| 6,962,102 | B1 | * | 11/2005 | Johnston et al. | 89/36.17 |

* cited by examiner

VEHICLE ARMOR SYSTEM

CROSS-REFERENCE TO RELATED APPLICATIONS

This application claims the benefit of U.S. Provisional Patent Application Ser. No. 60/579,642, filed Jun. 15, 2004, which is incorporated herein by reference in its entirety.

BACKGROUND OF THE INVENTION

1. Field of the Invention

The present invention relates to a vehicle armor system having a armored panels connected to a frame that is separate from the vehicle body structure.

2. Related Art

Conventional techniques for armoring street vehicles involve removal of the interior fittings, measuring the interior dimensions, fabricating a set of armor plates, and individually attaching the armor plates to the inside of the vehicle body structure. Armoring may be installed in various vehicle types, such as, for example, automobiles, vans, pickup trucks, and sport-utility vehicles (SUVs), and military vehicles, e.g., Jeeps, Humvees, etc. A fitting and installation for a typical vehicle may take 12 –14 weeks. Generally speaking, the armor must be assembled in the vehicle, rather than being preassembled, which increases the time the vehicle must be kept in the installation facility.

Conventional techniques are based on a weldment methodology or mechanical attachment, i.e., they rely on welding or attaching armor plates to an existing body structure of a vehicle, rather then providing an armor system having its own independent frame structure. However, the welding of armor plates directly to a vehicle body structure does not provide structural integrity independent of the vehicle structure, and therefore does not provide additional protection to vehicle occupants in the event of a collision or rollover. Nor does this approach facilitate preassembly of armor components outside of the vehicle.

Moreover, these conventional techniques do not include structural components designed to allow for movement of the armor plates, to absorb the kinetic energy of a ballistic impact or blast force. Rather, as discussed above, the armor plates are directly attached to the vehicle body structure, e.g., by welding or fasteners. Such static configurations increase the probability of failure of the armor components, such as ballistic penetration of the armor plate or detachment of the armor plate or fasteners from the vehicle body structure.

Conventional welding techniques include gas metal arc welding (GMAW), which is frequently referred to as "MIG" welding. MIG welding is a commonly used high deposition rate welding process in which wire is continuously fed from a spool. In gas tungsten arc welding (GTAW), which is frequently referred to as "TIG" welding, an arc is formed between a non-consumable tungsten electrode and the metal being welded. Gas is fed through the welding torch to shield the electrode and molten weld pool. In flux cored arc welding (FCAW), as in MIG welding, wire is continuously fed from a spool. Self-shielding flux cored arc welding wires or gas shielded welding wires may be used.

Another conventional welding technique is shielded metal arc welding (SMAW), which is frequently referred to as "stick" or covered electrode welding. In stick welding, the flux covering the electrode melts during welding and forms gas and slag to shield the arc and molten weld pool. The slag is chipped off the weld bead after welding. Resistance spot welding (RSW), resistance seam welding (RSEW), and projection welding (PW) are commonly used resistance welding processes. Resistance welding uses the application of electric current and mechanical pressure to create a weld between two pieces of metal. In these techniques, weld electrodes conduct the electric current to the two pieces of metal as they are forged together. Brazing is a joining processes where parts are joined without melting the base metals, using filler metals melt above 840° F.

Armor plates may be fabricated from heat-treated, dual-hard steel, which has different hardness properties from one side to the other. The "hard" side of the dual-hard steel must be installed to face outward from the vehicle, i.e., must be the impact side of the plate. However, welding must be done on the "soft" side of the dual-hard steel, to avoid weld failure. Consequently, fasteners often must be used to attach the dual-hard steel plates to the vehicle body structure in conventional armoring techniques. Such fasteners may become secondary projectiles during a ballistic or blast event.

SUMMARY OF THE INVENTION

In one aspect, the present invention provides an armor system for installation in a vehicle having a body structure. The armor system includes frame members joined to form a framework having openings. The framework is joined to the inside of the body structure of the vehicle. The system further includes brackets, each of which is joined to one of the frame members. The system further includes armor plates that are configured to cover the openings of the framework. Each plate is joined to at least one of the brackets, so that gaps between the armor plates are overlapped by the frame members.

Embodiments of the present invention may include one or more of the following features. The armor plates may be formed of dual-hard steel and may be oriented, so that a hard side of the dual-hard steel faces away from the interior of the vehicle.

The brackets mentioned above each may have two surfaces formed at a right angle, and pairs of the brackets may be joined together to form T-shaped members. The T-shaped members may be welded to the frame members, so that center portions of the T-shaped members extend from the frame members. The armor plates may be positioned within a corner formed by the right-angled surfaces of the brackets and may be welded to the center portions of the T-shaped members. The welding of the armor plates to the center portions of the T-shaped members may be done on the soft side of the dual-hard steel.

The armor system may include a gap cover plate covering a gap between adjacent ones of the armor plates and also covering the center portion of the T-shaped member between the adjacent armor plates. The gap cover plate may be welded onto respective surfaces of the adjacent armor plates. The center portion of the T-shaped member between the adjacent armor plates may extend beyond the surfaces of the adjacent plates, and the gap cover plate may be bent to accommodate the T-shaped member. Alternatively, the center portion of the T-shaped member between the adjacent armor plates may be flush with the surfaces of the adjacent plates, and in such case, the gap cover plate may be flat.

In another aspect, the present invention provides a method for installing an armor system in a vehicle having a body structure. The method includes the step of forming a number of frame members, joining at least one bracket to each of the frame members, and joining the frame members to form a framework having openings. The framework is joined to the inside of the body structure of the vehicle. A number of armor plates are formed and configured to cover the openings of the framework. Each of the armor plates is welded to at least one of the brackets, so that gaps between the armor plates are overlapped by the frame members.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
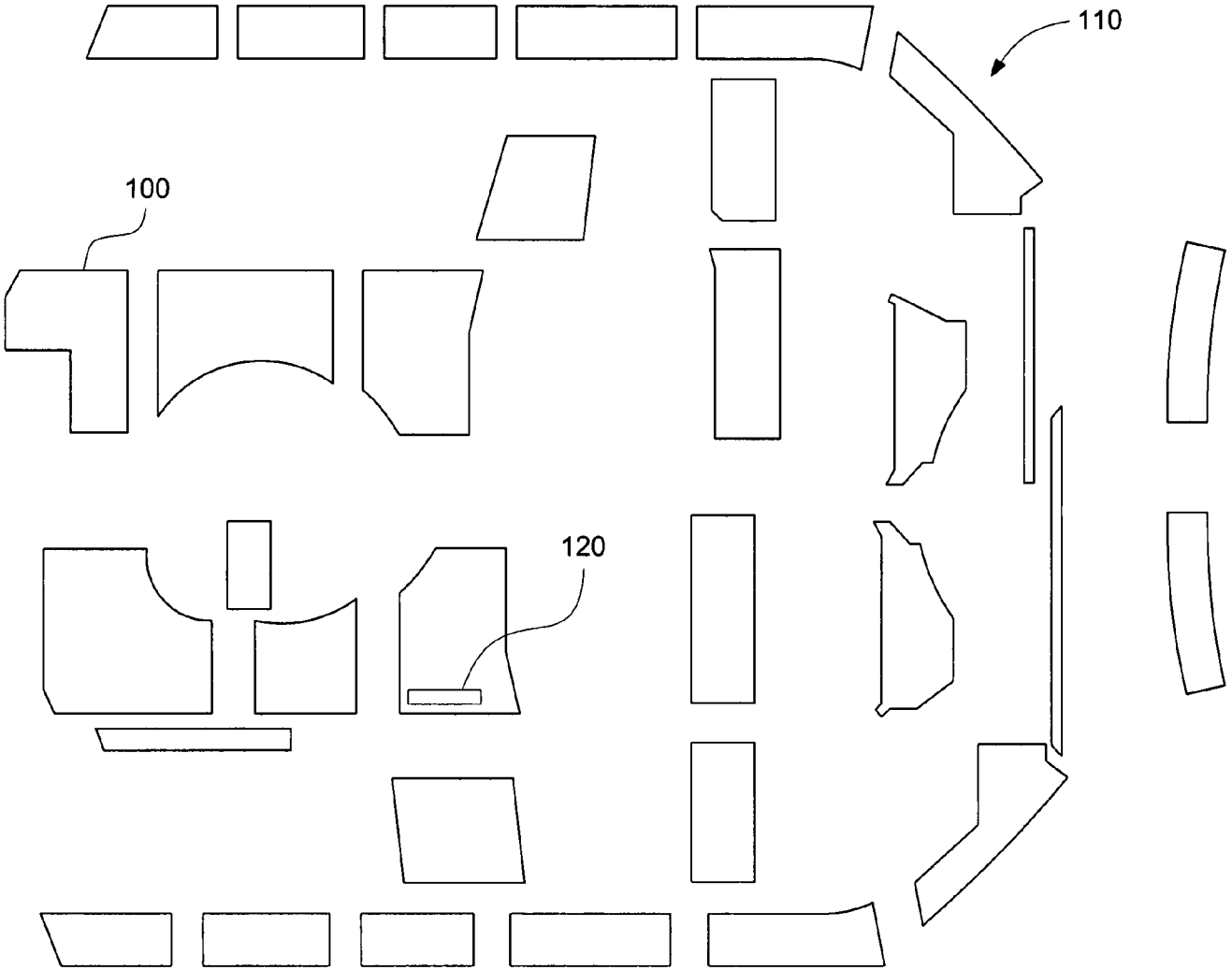
FIG. 1 shows an example of an armor plate map of an armor system for a vehicle.

An armor system in accordance with the present invention provides a structure to be installed inside the body structure of a vehicle to act as a shield against ballistic projectiles and blast forces. As shown in FIG. 1, the armor system includes a set of armor plates 100 that have been fabricated according to an armor plate map 110. The armor plates 100 may be formed, for example, of dual-hard steel. The map 110 includes outlines delineating the shape and size of each panel 100 and may include an identifier 120 for each panel. The map 110 also shows the arrangement of the panels 100 relative to each other as they will be installed within the vehicle.

The armor plate map 110 is created by making measurements within a vehicle and then determining the shapes and sizes of a set of armor plates 100 necessary to provide a complete shielding structure. The measurements may be made after the interior fittings have been removed from the vehicle using templates formed from a material that is easily cut into various shapes and sizes, such as cardboard or hardboard. The use of templates helps in the design of plates for irregularly-shaped portions of the vehicle interior to ensure complete coverage of the vehicle.

The templates are arranged within the vehicle to make the measurements based at least in part on the configuration of the vehicle body structure and the experience of the armor system designer. For example, a template may be positioned to cover a door panel. The size of the templates, and thus the resulting armor plates, may be limited by practical considerations, such as the maximum size that is easily handled by an installer or the maximum size accommodated by equipment used to fabricate the plates. For example, the maximum size plate may be determined to be about 20 by 30 inches due to the maximum size of the heat-treatment facility. These practical size constraints may result in the use of multiple panels to cover certain areas of the vehicle body structure, such as the roof, doors, and other surfaces.

The completed templates are measured, and the size and shape of the templates may be entered into a computer program, such as a computer-aided design (CAD) program, to generate the armor plate map. The use of a CAD program allows template shape and size data to be easily stored and manipulated. The armor plate map 110 may be printed using the CAD program as a design drawing to enable a manufacturing facility to fabricate the plates 100. In addition, the data may be transmitted electronically to the manufacturing facility. The stored data may be maintained in a database and retrieved as needed for the installation of armor into similar vehicles. For example, measurements made in a particular vehicle model may be used for the future installations in the same model without repeating the measurement process.

Figure 2:
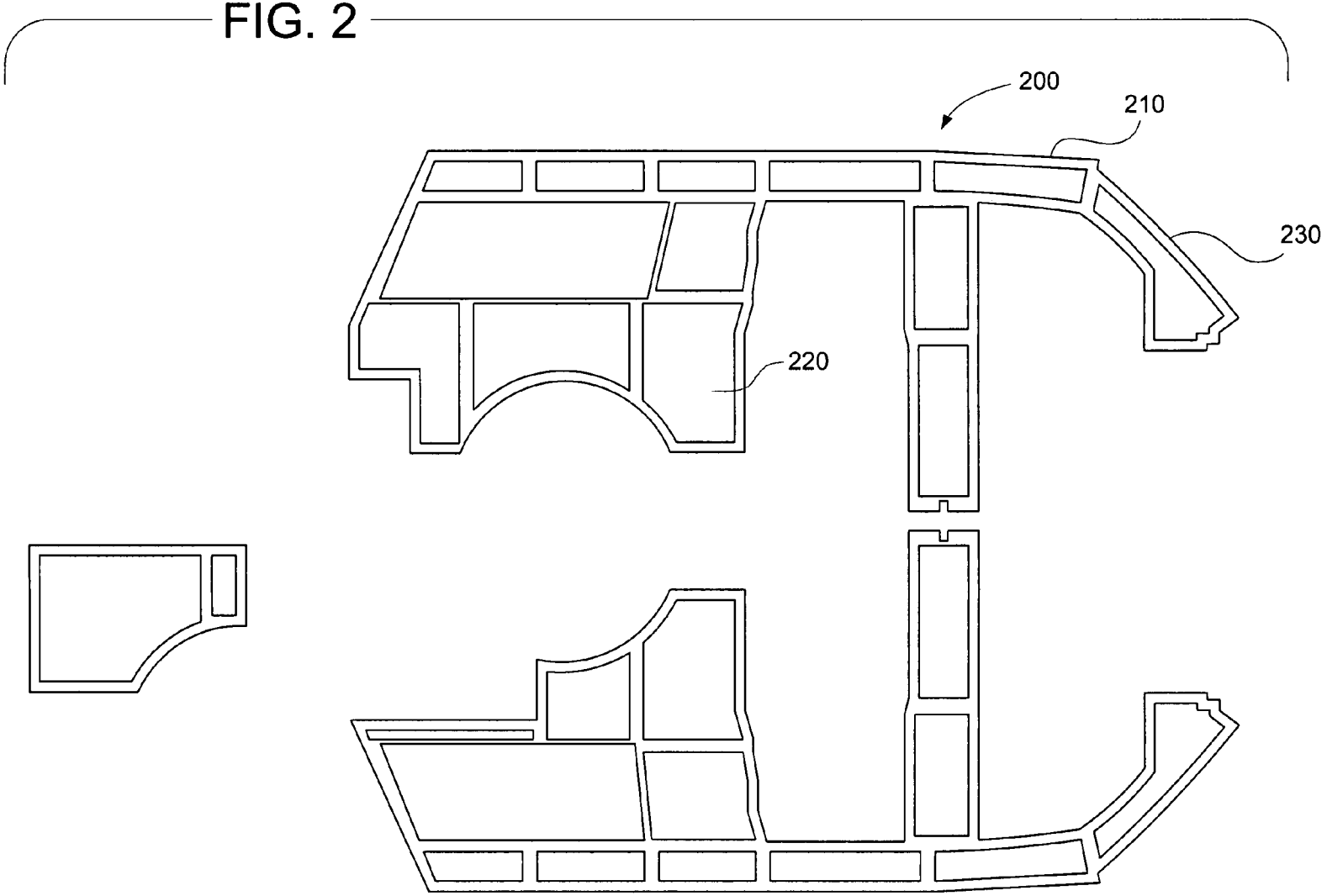
FIG. 2 shows an example of an armor system framework having openings for receiving armor plates, for installation into a vehicle.

As shown in FIG. 2, the armor system also includes a framework 200 into which the armor plates 100 are installed. The framework 200 is formed from elongate frame members 210 that are joined together to form a lattice-like structure. Various joining techniques may be used, including, but not limited to: MIG welding, TIG welding, flux cored arc welding, stick welding, resistance spot welding, resistance seam welding, projection welding, and brazing. Fasteners or other mechanical attachment structures may also be used in addition to, or in lieu of, these joining techniques.

The frame members 210 may be formed, for example, of monolithic steel of about 0.25 inches in thickness. The ends of the frame members 210 may be joined together directly, or the frame members 210 may be connected using joint plates, or both. The joint plates may be joined to partially overlap the ends of adjoining frame members 210 and may be curved or angled to fit the frame members to the shape of the vehicle body structure.

The openings 220 of the framework 200 are sized and shaped based on the dimensions of the armor panels 100, so that the panels fill the openings 220 and at least partially overlap the frame members 210. As further discussed below, the framework 200 provides a support structure for the armor plates 100 that is independent of the vehicle body structure. As such, the framework 200 provides additional structural strength to the vehicle body structure, which may be beneficial in the event of a rollover or other sort of accident. In addition, the frame members 210, which may also be referred to as "splice plates," cover gaps between the plates 100 to improve the ballistic and blast integrity of the armor system.

The framework 200 may be installed in the vehicle in assembled sections. For example, a side portion 230 of the framework 200 may be configured to cover one side of the vehicle. This side portion 230 may be installed independently of other sections of the framework, such as the roof section or the front or back sections. The framework sections are installed in the vehicle by joining, e.g., welding, the framework sections to the inside of the vehicle body structure. The frame members 210 may be welded directly to the vehicle body structure, or the joint plates between the frame members may be welded to the vehicle body structure. The armor plates 100 are attached to the framework as discussed below.

Figure 3:
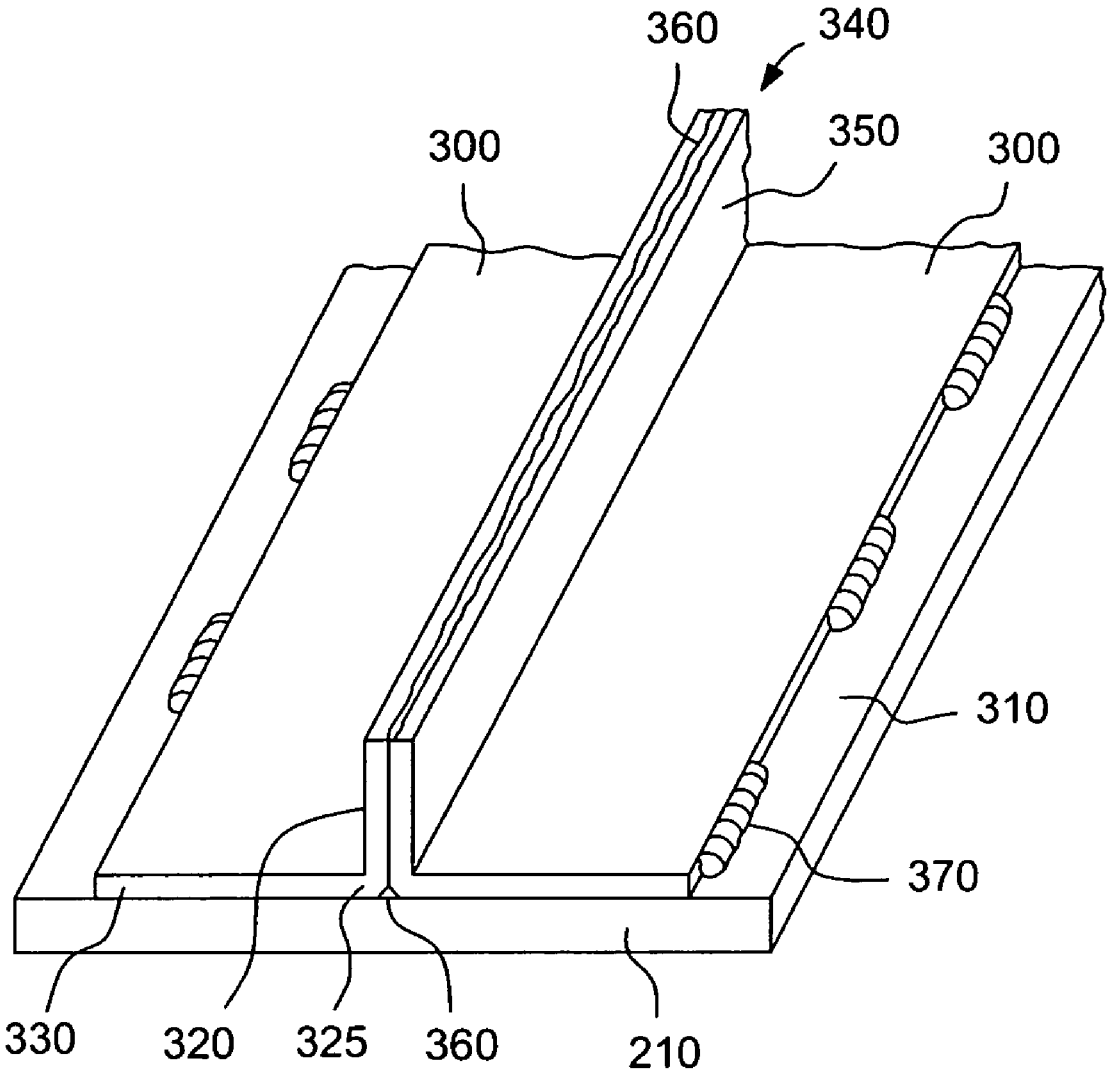
FIG. 3 shows a frame member having a pair of right-angle brackets welded thereon.

As shown in FIG. 3, each frame member 210 may have two elongated brackets 300 joined, e.g., welded, onto a surface 310 of the member 210. Various joining techniques may be used, including, but not limited to: MIG welding, TIG welding, flux cored arc welding, stick welding, resistance spot welding, resistance seam welding, projection welding, and brazing. Fasteners or other mechanical attachment structures may also be used in addition to, or in lieu of, these joining techniques. The brackets 300, generally speaking, may be any type of formed component amendable to attachment to the frame member 210 and to which the armor plates 100 can be secured, as discussed below.

The brackets 300 may, for example, be right-angle brackets formed from cold-rolled steel of about 0.125 inches thickness. One side 320 of the bracket may extend about 0.625 inches from the right-angle corner 325 (measured from the bottom edge of the bracket), while the other side 330 may extend between about 1.0 and about 1.125 inches (measured from the surface of the bracket facing the other bracket). Alternatively, the sides of the bracket 300 may be about the same length.

The brackets 300 may be welded together to form a T-shaped member 340 to be attached to the frame member, with the two shorter ends forming a central portion 350 of the "T". For example, the brackets 300 may be joined by continuous welds 360 on the adjacent ends 320 of the right angle and at the corner 325 of the right angle using a MIG welding process with 0.035 inch steel wire. The width of the T-shaped member 340 is sufficiently narrower than the frame member 210 to allow room for welding on the surface 310 of the fame member along the edge of the T-shaped member 340. For example, the edges of the T-shaped member 340 may be about 0.25 inches from the edge of the frame member 210 on both sides. The center portion 350 of the T-shaped member 340 extends toward the inside of the vehicle when the framework 200 is installed, i.e., the T-shaped member is attached to the non-impact side of the frame member.

The brackets 300, formed into the T-shaped member 340, may be joined to the surface 310 of the frame member 210 using periodically spaced welds 370 between the distal ends 330 of the right angle. For example, the brackets 300 may be welded to the surface 310 of the frame member 210 using welds 370 that are about one inch in length and spaced by about two inches. The welds 370 may be staggered, so as not to be aligned from one side to the other. This configuration increases the ballistic integrity of the system, because if the point of impact is between two welds 370 of one of the brackets 300, along the length of the bracket, it will be aligned with the weld 370 on the other bracket. The staggering also helps prevent small fragments of a projectile, from penetrating between the frame member 210, the brackets 300, and the armor plates 100.

Figure 4:
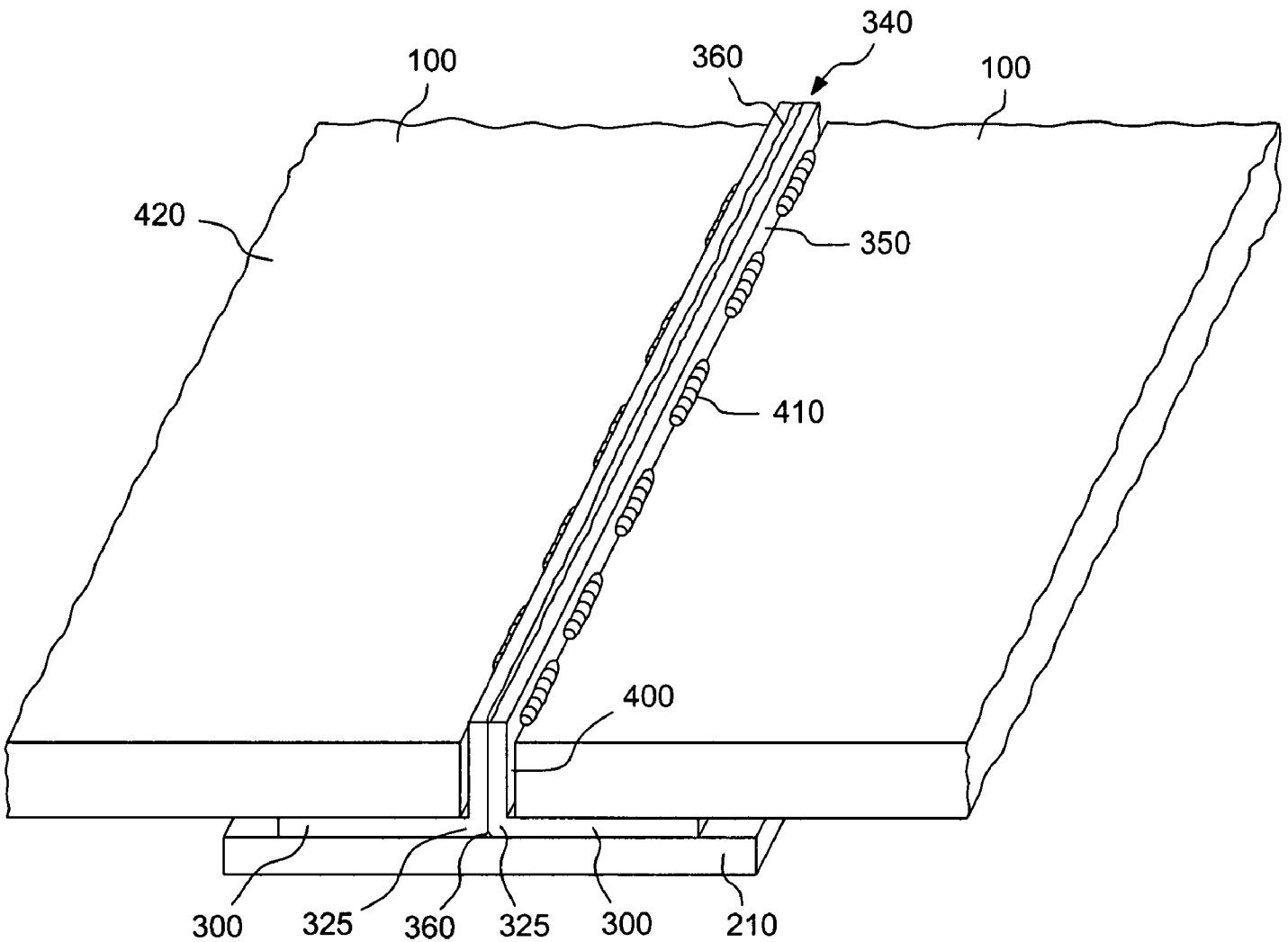
FIG. 4 shows the frame member of FIG. 3 with armor plates welded onto the brackets.

As shown in FIG. 4, the armor plates 100 are positioned in the corners 325 of the brackets 300, so as to rest on the portion of the brackets 300 closest the frame member 210. A gap 400 may exist between the plate 100 and the central portion 350 of the T-shaped member 340, which extends from the frame member 210. The armor plates 100 are joined along an edge of the plate to the central portion 350 of the T-shaped member 340 using, for example, welds 410 that are about one inch in length and spaced by about one inch. The welds 410 may be staggered, so as not to be aligned from one side of the T-shaped member 350 to the other, for increased system integrity.

Various joining techniques may be used to attach the armor plates, including, but not limited to: MIG welding, TIG welding, flux cored arc welding, stick welding, resistance spot welding, resistance seam welding, projection welding, and brazing. Fasteners or other mechanical attachment structures may also be used in addition to, or in lieu of, these joining techniques. Adhesives also may be used, particularly, for example, with armor plates formed of composite material, e.g., ceramics.

The joining of the armor plate 100 is done along the edge of the surface 420 of the plate 100 facing away the frame member, which is the non-impact side of the plate. If dual-hard steel is used as the material for the armor plates 100, the non-impact side of the plate is the soft side of the steel. Thus, the joining, e.g., welding, is done on the soft side of the steel, rather than the hard side, which improves the quality of the weld. Welding done to the hard side of the steel would be more susceptible to fracture under ballistic impact or blast conditions, which could allow the armor plates 100 to break away from the brackets 300.

Another advantage of this configuration is that it does not require the use of fasteners, which can become secondary projectiles in a ballistic event. However, fasteners can be used in this configuration in addition to or in lieu of welding, for example, for the attachment of the armor plates 100 to the brackets 300. The armor plates 100 may be attached to the brackets 300, either by welding or with fasteners, after the framework 200 is installed in the vehicle, in order to make system installation easier. This configuration also makes it easier to remove and replace individual armor plates 100, as the welds between the plates 100 and the brackets 300 may be ground down without the risk of damaging the vehicle body structure.

As noted above, the armor plates 100 may be formed, for example, of dual-hard steel of about 0.25 inches thickness. The dual-hard steel may be, for example, K12® Dual Hardness Armor Plate, supplied by Allegheny Ludlum of Washington, Pa. The dual-hard material has a high hardness front side and a softer back side. The purpose of the hard front side, i.e., impact side, is to break up or flatten the ballistic projectile, while the function of the softer back side is to capture the projectile. The composition of both faces is a Ni—Mo—Cr alloy steel, but the front side contains a higher carbon content, which leads to a higher hardness after heat treatment. The front and back sides are roll bonded by a multi-step process, which involves heating an assembly to a specific temperature and hot rolling it until the two sides develop a strong, metallurgical bond. The roll-bonded plates are annealed, sheared and flattened. Heat treatment, as further described below, is used to achieve the desired ballistics performance.

The armor plates 100 may be cut from larger piece of dual-hard steel using automated equipment or by manual cutting using outlines formed by the templates. The plates are then heat-treated for increased hardness. Generally speaking, steels are hardened by being heated to a temperature just above an upper transformation temperature, soaked long enough to ensure an austenitic structure, and then cooled rapidly. For example, the plates may be heated to a temperature of about 1560° F. for about 45 minutes and then quenched in an agitated fast oil quencher to hand-touch temperatures. The plates then are washed and cleaned.

After the hardening heat treatment, usually within about one hour, the plates are tempered to reduce brittleness. For example, the plates may be tempered at about 250° F. to about 325° F. for about two hours. In some alloy steels, tempering may increase hardness when tempered to certain temperature ranges. In most other materials, however, tempering causes some loss of hardness. The reduction in hardness due to tempering depends upon the tempering temperature—the higher the temperature, the softer the final material.

After tempering, the plates are sand-blasted and checked for hardness using standard testing equipment, such as a Rockwell hardness tester. Sample plates are subjected to ballistic testing, and the tempering temperature may be adjusted depending upon the results of the ballistic testing. For example, if the plates are too hard, which may result in cracking, the tempering temperature may be increased to reduce the hardness of the plate.

The resulting armor plates have a hard side having a hardness of about 58–62 Rc (Rockwell C), which will act to stop a ballistic projectile, and a soft side having a hardness of about 48–52 Rc. Other materials, both metal and non-metal, may be used for the armor plates, such as, for example, monolithic steel, titanium, various alloys, non-ferrous materials, e.g., aluminum, or composite materials, e.g., ceramics. Materials may be selected for the armor plates based on ballistic properties and the experience of the system designer, and the selected materials need not have varying hardness between faces.

Figure 5:
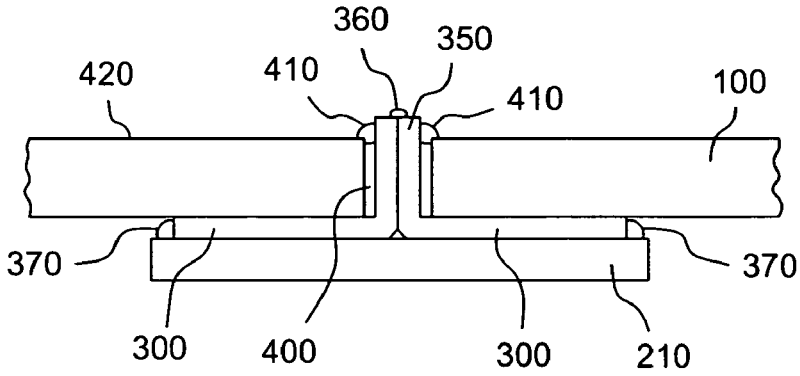
FIG. 5 shows an end view of a frame member with armor plates welded thereto of FIG. 4.

As noted above, and as shown in FIG. 5, there may be a gap 400 between the armor plates 100 and the center portion 350 of the T-shaped member, due to manufacturing and fabrication tolerances and other practicalities. The system components are configured to minimize this gap 400 to the extent practical, and it is typically less than about 0.05 inches. The joining 410 of the plate 100 to the brackets 300 is done across this gap 400.

In addition, although the plates 100 are shown as being flush against the lower portion of the bracket 300, there may be gaps between the plate 100 and the bracket 300 due to irregularities in the flatness of the plate 100. For example, the heat-treatment process may result in warping of the plates 100. Such irregularities can be easily accommodated by the configuration shown in FIG. 5, because the center portion 350 of the T-shaped member extends beyond the width of the armor plates 100. Thus, the plates 100 can be properly joined 410 to the brackets 300, even if there is a vertical misalignment of the edge of the plate 100. For example, the center portion 350 of the T-shaped member may extend beyond the surface 420 of the armor plates 100 by about 0.125 inches.

Figure 6:
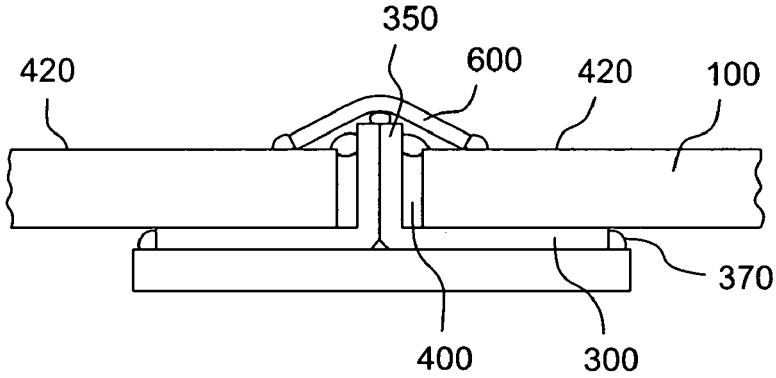
FIG. 6 shows an end view of a frame member with armor plates welded thereon, including an angled gap cover plate.

As shown in FIG. 6, if the gap 400 between the armor plates 100 and the brackets 300 is larger than the desired design value, e.g., larger than about 0.045 inches, or a predetermined threshold, e.g., larger than about 0.09 inches, a gap cover plate 600 may be attached to adjacent armor plates 100 to cover the gap 400 on the non-impact side of the armor system. The gap cover plate 600 is an elongate member, which may be formed for example of monolithic steel of about 0.1875 to about 0.25 inches thickness. The gap cover 600 may be angled to fit around the end of the center portion 350 of the brackets and is wide enough to reach the surface 420 of the armor plates 100 on either side of the gap 400, so that it can be joined to these surfaces 420. For example, the gap cover 600 may be about two inches wide and may overlap each plate by at least about three quarters of an inch.

Figure 7:
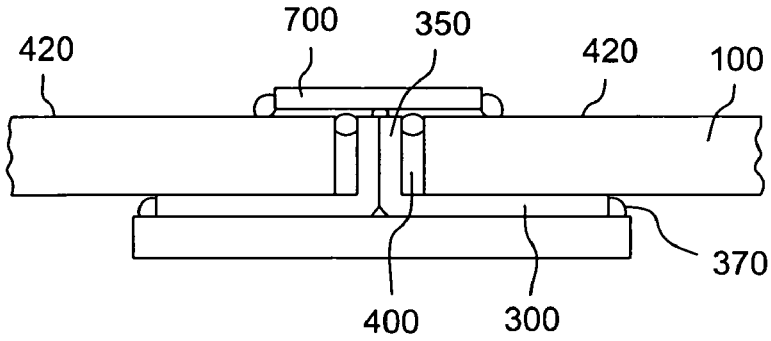
FIG. 7 shows an end view of an alternative embodiment of a frame member with armor plates welded thereon, including a flat gap cover plate.

In the alternative embodiment of FIG. 7, the end of the center portion 350 of the brackets 300 is approximately flush with the surfaces 420 of the armor plates 100. In such a case, the gap cover 700 may be a flat elongate member that overlaps and is welded onto the surfaces 420 of the armor plates 100 on either side of the gap 400.

Figure 8:
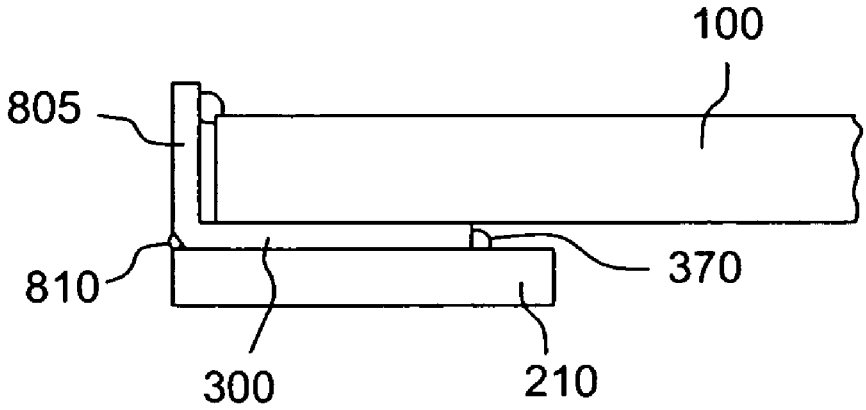
FIG. 8 shows an end view of a frame member configured for an edge of the framework.

FIG. 8 shows a frame member 210 configured for an edge position in the framework 200, such as the edge surrounding a door or a window of the vehicle. The frame member 210 has a single right-angle bracket 300 joined, e.g., welded, thereon, such that the side 805 of the bracket 300 that extends from the surface of the frame member 210 is approximately flush with the edge of the frame member 210. The bracket 300 is joined to the surface of the frame member 210 in a manner similar to that discussed above, e.g., using welds 370 that are about one inch in length and spaced by about two inches. The corner of the bracket 300 may be welded to the frame member 210 using a continuous weld 810.

Using edge frame members of the type shown in FIG. 8, the framework 200 can provide openings that allow for the installation of transparent armor panels, such as bullet-resistant glass. The transparent panels may be attached to the framework with a bonding material. The bonding may be done from the outside, or from the inside, in order to provide a lip around the transparent panel. These configurations are designed to keep the glass away from metal, because such contact may cause the glass to chip and break. The resulting system provides transparency while maintaining proper overlapping protection with the rest of the framework.

Figure 9:
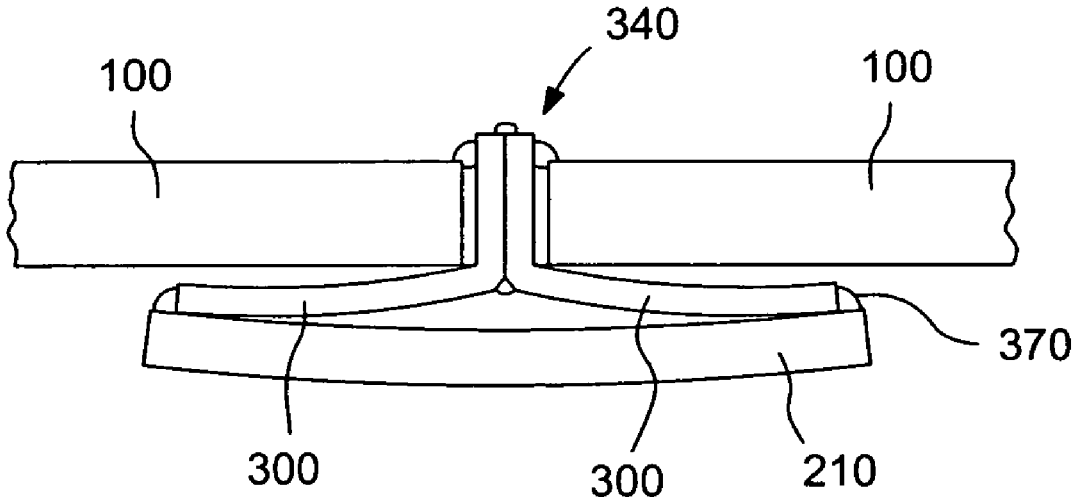
FIG. 9 shows an end view of a frame member with armor plates of FIG. 5 following ballistic impact.

The armor system of the present invention is dynamic, in the sense that it allows for movement of the system components in response to a ballistic or blast impact. FIG. 9, for example, depicts an end view of a frame member 210, brackets 300 and armor plate 100 following ballistic impacts on the plates. The force on the plate 100 causes the T-shaped member 340, which is formed of relatively flexible, cold-rolled steel, to bow and separate from the frame member 210, thus absorbing at least part of the kinetic energy imparted by projectile or blast. This dynamic reaction arises because, as discussed above, the brackets 300 are joined together to form the T-shaped member 340, which is in turn attached to the frame member 210 by welds 370 at the edges of the brackets 300. In addition, the frame member 210 has flexibility and may bend slightly as the T-shaped member 340 pulls away from its surface.

Moreover, as discussed above, the frame members are interconnected to form a structure that is independent of the vehicle body structure. As such, the system provides lateral, longitudinal, and axial support as an independent dynamic structure. Thus, the framework itself may flex to absorb the force of a ballistic or blast event. The dynamic nature of the system components helps lessen the chance of weld fracture and failure, which may result in a loss of system integrity.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. An armor system for installation in a vehicle having a body structure, the armor system comprising:

a plurality of frame members joined to form a framework having openings, the framework being joined to the inside of the body structure of the vehicle;

a plurality of brackets, each of the brackets being joined to one of the frame members; and a plurality of armor plates configured to cover the openings of the framework, each plate being joined to at least one of the brackets, so that gaps between the armor plates are overlapped by the frame members, wherein the brackets each comprise two surfaces formed at a right angle, and pairs of the brackets are joined together to form T-shaped members, the T-shaped members being joined to the frame members, so that center portions of the T-shaped members extend from the frame members.

2. The armor system of claim 1, wherein the armor plates comprise dual-hard steel, and the armor plates are oriented so that a hard side of the dual-hard steel faces away from an interior of the vehicle.

3. The armor system of claim 1, wherein the armor plates comprise at least one of the following materials: monolithic steel, titanium, aluminum, or composite materials.

4. The armor system of claim 1, wherein the T-shaped members are welded to the frame members using periodic welds along the edges of the T-shaped members, the welds being staggered from one side to another side, in a length-wise direction of the T-shape members.

5. The armor system of claim 1, wherein the armor plates are positioned within a corner formed by the right-angled surfaces of the brackets, and the armor plates are welded to the center portions of the T- shaped members.

6. The armor system of claim 5, wherein the armor plates comprise dual-hard steel, and the welding of the armor plates to the center portions of the T-shaped members is done on a soft side of the dual-hard steel.

7. The armor system of claim 5, further comprising a gap cover plate covering a gap between adjacent ones of the armor plates and also covering the center portion of the T-shaped member between the adjacent armor plates, the gap cover plate being welded onto respective surfaces of the adjacent armor plates.

8. The armor system of claim 7, wherein the center portion of the T-shaped member between the adjacent armor plates is flush with the surfaces of the adjacent plates, and the gap cover plate is flat.

9. The armor system of claim 7, wherein the center portion of the T-shaped member between the adjacent armor plates extends beyond the surfaces of the adjacent plates, and the gap cover plate is bent to accommodate the T-shaped member.

10. The armor system of claim 5, wherein the armor plates are joined to the center portions of the T-shaped members using mechanical fasteners.

11. The armor system of claim 5, wherein the armor plates are joined to the center portions of the T-shaped members using adhesives.

12. A method for installing an armor system in a vehicle having a body structure, the method comprising the steps of:

forming a plurality of frame members;

joining at least one bracket to each of the frame members;

joining the plurality of frame members to form a framework having openings;

joining the framework to the inside of the body structure of the vehicle;

forming a plurality of armor plates configured to cover the openings of the framework; and joining each of the armor plates to at least one of the brackets, so that gaps between the armor plates are overlapped by the frame members, wherein the brackets each comprise two surfaces formed at a right angle, and pairs of the brackets are joined together to form T-shaped members, the T-shaped members being joined to the frame members, so that center portions of the T-shaped members extend from the frame members.

13. The method of claim 12, wherein the armor plates comprise dual-hard steel, and the armor plates are oriented so that a hard side of the dual-hard steel faces away from an interior of the vehicle.

14. The method of claim 12, wherein the T-shaped members are welded to the frame members using periodic welds along the edges of the T-shaped members, the welds being staggered from one side to another side, in a length-wise direction of the T-shape members.

15. The method of claim 12, wherein the armor plates are positioned within a corner formed by the right-angled surfaces of the brackets, and the armor plates are welded to the center portions of the T- shaped members.

16. The method of claim 15, wherein the armor plates comprise dual-hard steel, and the welding of the armor plates to the center portions of the T-shaped members is done on a soft side of the dual-hard steel.

17. The method of claim 15, further comprising the step of welding a gap cover plate onto respective surfaces of adjacent ones of the armor plates, so as to cover a gap between the adjacent armor plates.

18. The method of claim 17, wherein the center portion of the T-shaped member between the adjacent armor plates is flush with the surfaces of the adjacent plates, and the gap cover plate is flat.

19. The method of claim 17, wherein the center portion of the T-shaped member between the adjacent armor plates extends beyond the surfaces of the adjacent plates, and the gap cover plate is bent to accommodate the T-shaped member.

* * * * *